US009289105B2

(12) United States Patent
Moes

(10) Patent No.: US 9,289,105 B2
(45) Date of Patent: Mar. 22, 2016

(54) DEVICE AND METHOD FOR WET FLOOR CLEANING

(75) Inventor: Freddy Moes, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1261 days.

(21) Appl. No.: 13/123,766

(22) PCT Filed: Oct. 8, 2009

(86) PCT No.: PCT/IB2009/054407

§ 371 (c)(1),
(2), (4) Date: Apr. 12, 2011

(87) PCT Pub. No.: WO2010/044022

PCT Pub. Date: Apr. 22, 2010

(65) Prior Publication Data

US 2011/0180105 A1 Jul. 28, 2011

(51) Int. Cl.

| | |
|---|---|
| ***B08B 3/04*** | (2006.01) |
| ***A47L 11/292*** | (2006.01) |
| ***A47L 11/08*** | (2006.01) |
| ***A47L 11/33*** | (2006.01) |
| ***A47L 11/40*** | (2006.01) |

(52) U.S. Cl.

CPC ..... *A47L 11/292* (2013.01); *A47L 11/085* (2013.01); *A47L 11/33* (2013.01); *A47L 11/4041* (2013.01); *A47L 11/4077* (2013.01); *B08B 3/04* (2013.01)

(58) Field of Classification Search

CPC . A47L 11/4041; A47L 11/28; A47L 11/4077; A47L 11/408; B08B 3/04

USPC ..... 15/50.3, 52, 52.1, 88.4, 308, 248.2, 15/328, 322, 320, 420, 1.7, 247, 24, 29, 15/103

See application file for complete search history.

(56) References Cited

U.S. PATENT DOCUMENTS

| | | | | |
|---|---|---|---|---|
| 3,457,582 | A * | 7/1969 | Sandor | 15/248.2 |
| 3,656,209 | A * | 4/1972 | Kinser | 15/349 |
| 4,360,946 | A * | 11/1982 | Marshall et al. | 15/321 |
| 4,654,916 | A | 4/1987 | Postonen et al. | |
| 5,086,539 | A | 2/1992 | Rench | |
| 5,287,581 | A | 2/1994 | Lo | |

FOREIGN PATENT DOCUMENTS

| | | |
|---|---|---|
| CN | 86108272 | 12/1986 |
| CN | 86108272 A | 6/1988 |
| FR | 2495461 | 6/1982 |
| GB | 2126473 | 3/1984 |
| WO | 2007047856 | 4/2007 |

* cited by examiner

*Primary Examiner* — Laura C Guidotti

(57) ABSTRACT

A floor cleaning device is disclosed. It comprises a brush, which is rotatable around an axis of rotation, and a cover having a cover surface which faces the axis of rotation and has a plurality of ridges constituting liquid channels between them for transporting liquid to outfalls provided at lower ends of the liquid channels. In addition, a method of cleaning a floor is disclosed. The method comprises the steps of providing a brush, bringing the brush into contact with the floor, moistening the brush with a fluid, for example, a cleaning solution, rotating the brush, collecting droplets of fluid, released from the brush due to a centrifugal force associated with its rotational motion, in a plurality of liquid channels provided on a cover, and guiding the collected fluid through the liquid channels towards outfalls provided at lower ends of the liquid channels.

10 Claims, 3 Drawing Sheets

DEVICE AND METHOD FOR WET FLOOR CLEANING

FIELD OF THE INVENTION

The present invention relates to equipment for floor maintenance, in particular to a wet floor cleaning device and to a method for cleaning a floor.

BACKGROUND OF THE INVENTION

Many wet floor cleaning apparatuses or devices comprise a rotatable brush which is continually wetted as it scrubs the surface of a floor to be cleaned. The brush is typically wetted with a cleaning solution that enhances the cleaning process. Unfortunately, the use of a wetted brush may leave behind cleaning solution residue in the form of a trail or a series of small puddles of cleaning solution. This even applies to cleaning devices that are capable of evenly and sparingly wetting the brush. A floor cleaning device comprising a brush that is rotatable around an axis of rotation, and a cover having a cover surface that faces the axis of rotation is known from U.S. Pat. No. 5,086,539. U.S. Pat. No. 5,086,539 discloses a carpet cleaning machine including a pair of spaced, long-bristles, counter-revolving brushes for stroking solvent-moistened cleaning granules into and across carpet fibers. A shroud is disposed above the brushes and has a bottom surface spaced from the brushes.

The trail and the small puddles have their origin in the rotational motion of the brush, which may cause the liquid in and on the brush to be swung outward, off its surface. To prevent droplets shaken out of the brush from being scattered all over the floor, the rotating brush is typically shielded from its surroundings by a cover or splashguard which partly surrounds it. Droplets of cleaning solution caught by the cover will adhere to its surface and aggregate into somewhat larger drops. Once the drops have reached a sufficient weight, they may run downward along the surface of the cover under the influence of gravity, and drip down onto the floor from a lower edge thereof. These relatively small drops in themselves are not a major issue, as they are typically distributed across a larger surface (the floor cleaning devices moves during use), and are small enough to dry up quickly. The actual problem is caused by the fact that non-level operation of the cleaning device, which may result directly from use on non-level floors, creates a lowest point on the cover. Liquid drops from all over the cover will collectively flow to this lowest point. From there they will subsequently break loose from the cover surface in a seeping fashion, or possibly as a genuine torrent when the cleaning device is suddenly inclined. This may leave behind a concentrated trail or puddle of cleaning solution on the floor being cleaned. Such liquid trails/puddles may locally make a floor unexpectedly slippery, posing a hazard to people, and may eventually dry up while leaving spots on the floor.

SUMMARY OF THE INVENTION

It is an object of the present invention to mitigate or overcome the problem of liquid trails and puddles particularly due to non-level use of a floor cleaning device. According to one aspect of the invention, this problem is solved in that the cover has a cover surface which is provided with a plurality of ridges, said ridges forming liquid channels between them for transporting liquid to outfalls provided at lower ends of the liquid channels.

The cover surface faces the rotational axis of the brush. Consequently, when the brush is moistened and rotated during use, it will be bombarded with tiny droplets. These droplets will aggregate into drops and run downward along the cover surface under the action of gravity, thereby snowballing with other droplets to form (tiny) liquid streams. The ridges provided on the cover surface may be considered as levees that channel these liquid streams between them but do not allow the streams to merge. By keeping the streams separate, excessive accumulation of liquid at a single point is prevented, even when the cover is not in its level orientation. Instead, the channels between the ridges guide the liquid in relatively small quantities towards a lowest point or outfall associated with each channel, from where the liquid may trickle down onto the floor. The separate liquid channels constituted by the ridges thus allow a fine discharge distribution (satisfactory spread) of liquid collected by the cover surface, averting the creation of noticeable trails of liquid behind the cleaning device.

According to another aspect of the invention, a method of cleaning a floor is provided. The method comprises the steps of providing a brush, bringing the brush into contact with the floor, moistening the brush with a fluid, for example, a cleaning solution, and rotating the brush. The method further comprises the steps of collecting droplets of fluid, released from the brush due to a centrifugal force associated with its rotational motion, in a plurality of liquid channels provided on a cover, and guiding the collected fluid through the liquid channels towards outfalls provided at lower ends of the liquid channels.

These and other features and advantages of the invention will be more fully understood from the following detailed description of embodiments of the invention, described with reference to the accompanying drawings, which are illustrative and do not limit the invention.

DESCRIPTION OF EMBODIMENTS

Figure 1:
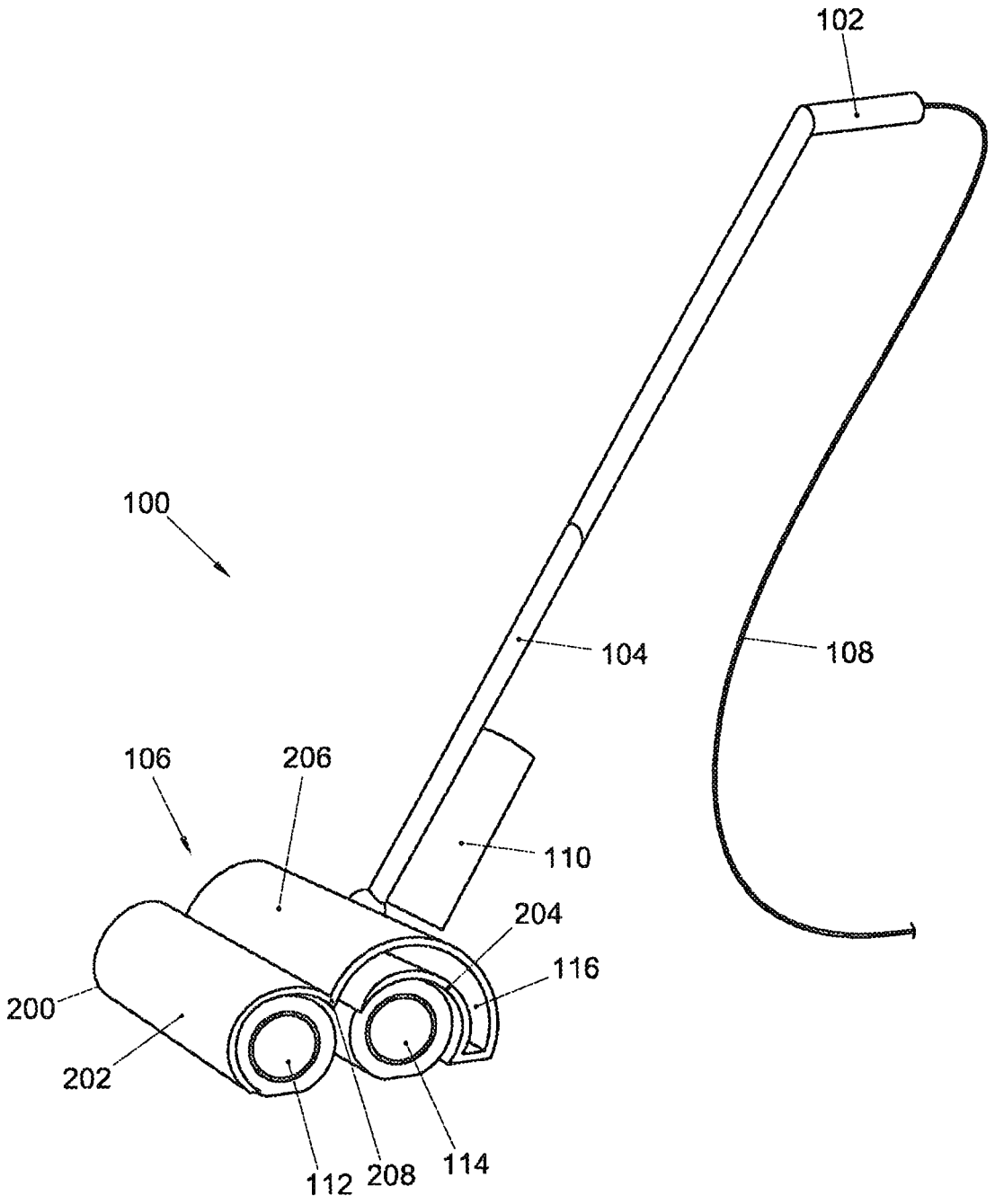
FIG. 1 is a perspective view of an example of a wet floor cleaning device according to the present invention.

In the drawings, identical reference numerals denote the same or similar elements or acts. Shapes, sizes, angles and relative positions of elements in the drawings may not be drawn to scale and may be arbitrarily enlarged and positioned to improve drawing legibility. In addition, the examples of the floor cleaning device and its components are shown in a natural working orientation, i.e. a level or somewhat inclined orientation with respect to the horizontal. Consequently, where relevant, gravity points downward in the drawings.

FIG. 1 is a perspective view of an example of a wet floor cleaning device 100 according to the present invention. The device includes a handle 102 which is connected to a housing 106 via a connection rod 104. The housing 106 comprises a cover 200 and a waste or storage reservoir 116. The housing 106 further accommodates two brushes 112, 114 and an electromotor (not shown) for driving the brushes. A power cord 108 provided with a conventional plug on one end (not shown) is connected to the handle 102 for supplying electric power from the mains to the electromotor. A cleaning solution reservoir 110 is attached to the connection rod 104.

The handle 102 allows a user to grip the cleaning device 100 and steer it around. The bar-like handle 102 shown in FIG. 1 is designed for one-handed operation, though other embodiments may feature a handle that be can gripped more easily with two hands. The handle 102 may be clad with an anti-skid material and/or provided with a hand imprint to improve gripability. It may also be provided with a control for operating the electromotor which drives the brushes 112, 114. It will be clear that handles of different shapes and sizes relative to the one shown in FIG. 1 may be used in combination with the cleaning device 100.

A connection rod 104 transfers the motion imparted to the handle 102 by the user to the housing 106. The connection rod 104 may also serve as a duct for electric wiring extending from the handle 102 to the electromotor so as to supply the latter with power, and as a support element for, for example, the cleaning solution reservoir 110.

The housing 106 accommodates two brushes 112, 114. In the case of a forward motion of the cleaning device 100, brush 112 may be termed the leading brush, while brush 114 may be termed the trailing brush. Both brushes 112, 114 are substantially cylindrical, though other brush shapes, e.g. prismatic, may be used as well. The longitudinal axes of the brushes 112, 114 coincide with their respective axes of rotation, and, when in use, are oriented substantially parallel to a floor being cleaned. Each brush 112, 114 may comprise a substantially cylindrical jacket or prism jacket-shaped core. An exterior of the core may be furnished with brush material, e.g. soft microfiber fabric or tufts of synthetic filaments. The brush material may be provided on a liquid-permeable backing by means of which it is attached, e.g. glued, to the outside surface of the core. The liquid-permeable backing may be a part of a fluid supply system which transports cleaning solution to the brush material. The fluid supply system may further include small (radially extending) core perforations. These perforations may allow cleaning solution, supplied from the cleaning solution reservoir 110 into an inner volume of the core when it rotates, to be transported outward, out of the core, into the brush material via the permeable backing. Due to a centrifugal force associated with the rotational motion of the core, the cleaning solution may be squeezed out of the core, through the perforations, but this is not the only possibility. For example, gravity and capillary action are other mechanisms by means of which the cleaning solution may be distributed from the core volume into the brush material. Moreover, an altogether different fluid supply system for wetting the brush material may of course be used, for example, a system based on moistening the brush material by spraying it with a cleaning solution or by exposing the material to a vapor thereof.

In use, the brushes preferably rotate in opposite directions. In the view of FIG. 1, this is a counterclockwise and a clockwise rotation of the brushes 112 and 114, respectively. The brushes 112, 114 may be subjected to rotational speeds of several thousands of revolutions per minute, e.g. 2500-14000 rpm, or more specifically, e.g. 8000 rpm. Consequently, when the brushes 112, 114 rotate in opposite directions as described, they will effect an upwardly directed air flow between them, carrying dirt particles scrubbed off the floor. The air flow may be deflected by the cover part 206 towards a waste reservoir 116 in which the dirt particles may be deposited. The waste or storage reservoir 116 is preferably detachable from the housing 106, so that it can be emptied easily.

A cover 200 comprising cover parts 202, 204 and 206 roofs over the two brushes 112, 114, from the floor up. The cover part 202 roofs over leading brush 112 and serves mainly as a splashguard. Trailing brush 114 is partly roofed by the two cover parts 204, 206, which is a result of the fact that the cover 200 in the embodiment shown in FIG. 1 also embodies the storage reservoir 116. The inner cover part 204 serves primarily as a splashguard for collecting liquid droplets being launched from the rotating brush 114. The outer cover part 206 serves as an air flow deflector for guiding the air flow generated by the two rotating brushes 112, 114 to the storage reservoir 116. Where, viewed in a radial direction with respect to the longitudinal axis of brush 114, the outer layer 206 is not shielded by the inner layer 204, the outer layer 206 may have a splashguard function as well. In the embodiment shown in FIG. 1, such is the case near the kink 208 in the cover 200 (see also FIG. 2, to be described hereinafter).

In the embodiment shown in FIG. 1, the side ends of the cylindrical brushes 112, 114 are left uncovered by cover 200. In a different embodiment of the floor cleaning device 100, the cover 200 may shield these side ends as well, so as to create a wet chamber between itself and the floor in which the rotating brushes 112, 114 are accommodated. Such a wet chamber may keep radially and axially splattering liquid inside and additionally contributes to the safety of the device, as it shields the fast moving parts of the floor cleaning device 100 from the user.

Figure 2:
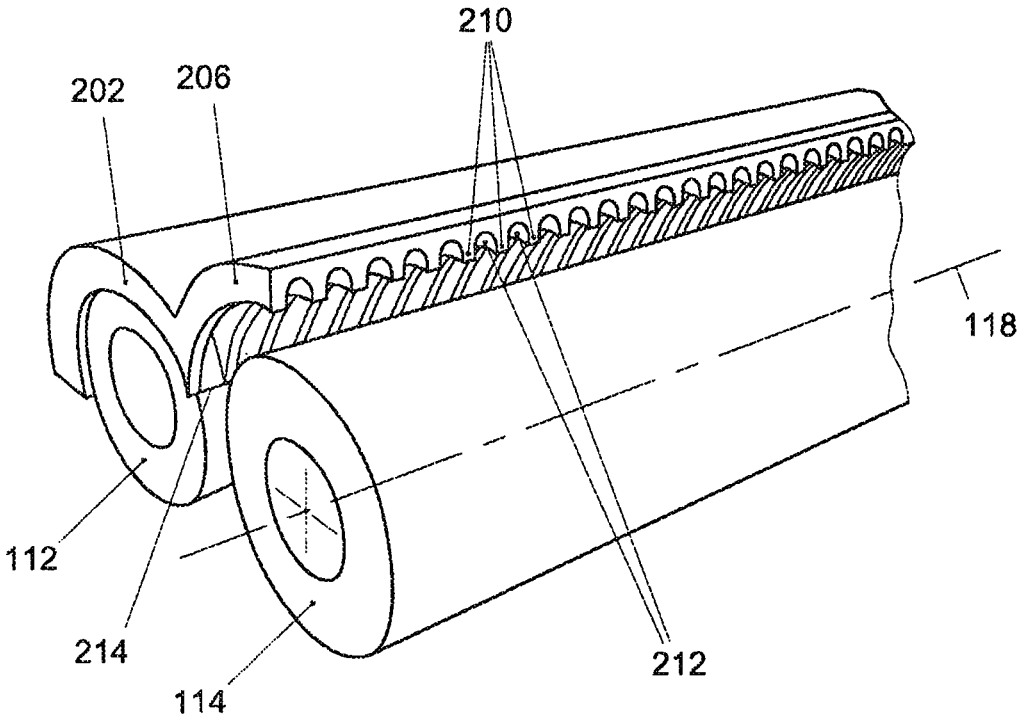
FIG. 2 is a perspective view of the two brushes and the cover shown in FIG. 1, the cover being shown in a cross-section.
Figure 3:
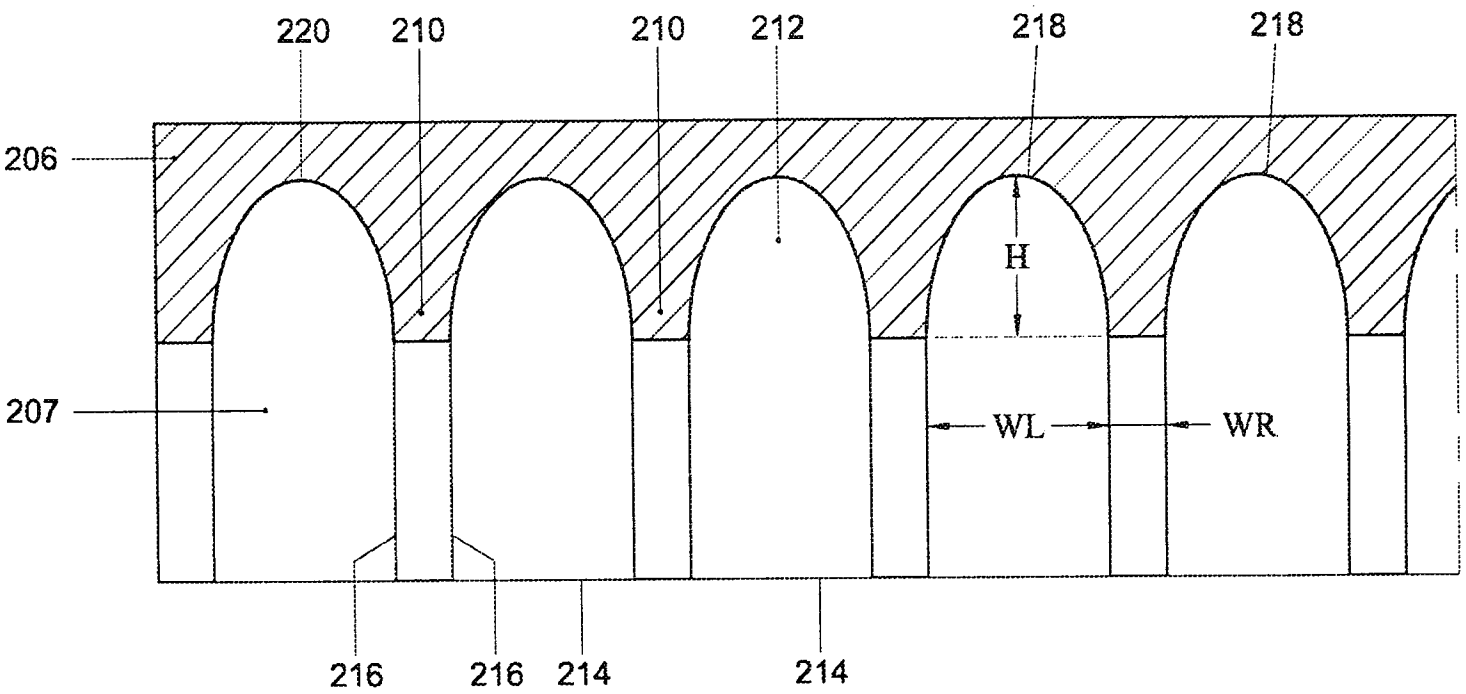
FIG. 3 is an orthogonal cross-sectional view of the cover shown in FIG. 2.

The surface structures of the cover parts 202, 204, 206 may be identical, and can best be illustrated with reference to FIG. 2 and FIG. 3. FIG. 2 is a perspective view of the two brushes 112, 114 and the cover 200 shown in FIG. 1, cover part 206 thereof being shown in a cross-section for clarity. FIG. 3 shows the portion of cover part 206 that is visible in FIG. 2 in an orthogonal cross-sectional view. Clearly visible in both FIG. 2 and FIG. 3 is a plurality of ridges 210 provided on the cover part surface 207 (see FIG. 3) of cover part 206. The ridges 210 protrude from the cover part surface 207 and form liquid channels 212 between them.

The ridges 210 stretch along the curved surface 207 of cover part 206 and can be said to extend in a direction having a component parallel to the direction of gravity at virtually any point. (The only point where a ridge 210 provided on the approximately semi-cylindrical cover part 206 does not extend in the direction of gravity to some degree is the apex of the curve described by the ridge, which apex has a horizontal tangent and is not shown in FIG. 2 and FIG. 3.) Tilting the floor cleaning device 100 from its level working orientation into a reasonably inclined working orientation, for example, ±15 degrees with respect to the direction of gravity, does not change this. Consequently, the ridges 210 extend at least partly in the direction of gravity when the floor cleaning device 100 is in a working orientation (level or inclined), allowing them to guide liquid down the liquid channels 212 towards outfalls 214 provided at the ends thereof.

The ridges 212 extend substantially parallel to each other, allowing efficient use of cover part surface 207 by the provision of many parallel channels 212, which corresponds to a high liquid channel density and, in turn, to a fine outfall distribution (i.e. spread of discharged liquid).

The interspacing between the ridges 210, corresponding to the width WL of the liquid channels 212, is preferably such that the liquid channels do not collect liquid through capillary action. Capillary behavior, which may manifest itself in liquid channels 212 that are too narrow, may inhibit the transport of liquid through the channels towards the outfalls 214. It is noted that the critical width WL at which a liquid channel 212 may exhibit capillary behavior is dependent on the characteristics of the liquid which is to be guided through the channel.

The interspacing WL between the ridges 210 may reflect the moistening profile of the brush 114. For example, axial regions of the brush 114 that are heavily moistened may correspond to a cover part surface 207 section having a relatively large number of liquid channels 212 per unit of axial length (i.e. small interspacing WL), whereas moderately moistened axial brush regions may correspond to cover part surface sections having a relatively small number of liquid channels per unit of axial length (i.e. large interspacing WL). After all, brush regions that are moistened to a greater extent will cast off more liquid, increasing the need for fine channeling. In the case of an axially uniformly moistened brush 114, the interspacing WL between the ridges 210 is preferably the same for any two adjacent ridges, as shown in FIG. 2. and FIG. 3.

Liquid channels 212 are preferably provided on the cover part surface 207 over the full (axial or longitudinal) length of the brush 114 being shielded, so as to be present wherever liquid is launched off the brush due to its rotational motion. This implies that the width WR of the ridges 210—i.e. the spacing between the liquid channels 212—may be relatively small.

Generally, the ridges 210 that define the liquid channels 212 do not need to protrude very far from the cover part surface 207. That is, their height H is preferably sufficient to halt the axial flow of liquid that may result from an inclined orientation of the floor cleaning device 100, so as to keep collected liquid inside a liquid channel, but no greater than that. Typically, a maximum ridge height of 5 mm suffices.

The side surfaces 216 of the ridges 210 may be preferably oriented perpendicularly with respect to the inner surface 207 from which the ridges protrude. An acute angle between a side surface 216 and the inner surface 207 corresponds to a ridge 210 essentially shielding a liquid channel 212 from incoming droplets, which is at variance with the very function of the liquid channel, whereas an obtuse angle may allow liquid from within the liquid channel to easily overflow the ridge and leave the confines of the channel.

Although the liquid channels 212 serve to collect and transport liquid, they will inevitably collect dirt particles as well. The dirt particles may stick to the cover 200, aggregate, and eventually even clog one or more liquid channels. To allow easy cleaning of the inside cover part surface 207, in particular of the liquid channels 212, the cross-sectional profiles of the liquid channels are preferably defined by a smooth curve. Accordingly, sharp, hardly accessible corners in which dirt may accumulate are prevented. In FIG. 2 and FIG. 3, the side surfaces 216 of the ridges 210 combine with the bottom sides 218 of the liquid channels 218 in a smooth curve 220.

In the configuration of FIG. 2 and FIG. 3, the ridges 210 on the cover part surface 207 extend in a direction substantially perpendicular to the axis of rotation 118 of the brush 114. Accordingly, the ridges 210 span the cover part surface 207 but still form relatively short liquid channels 212 towards their outfalls 214. This is generally desirable, as the shorter a liquid channel 212, the less liquid it will collect, guide and eventually discharge. Short channels 212 thus allow a finer discharge distribution (better spread) of liquid collected by the cover part surface 207, thereby averting the creation of noticeable trails of liquid behind the cleaning device 100. It is noted, however, that the same effect may be achieved in other configurations employing liquid channels that extend parallel to the axis of rotation. For example, a configuration wherein a brush rotates around a substantially vertical axis may call for a substantially vertically oriented cylindrical jacket-shaped cover which, on an inner surface thereof, is provided with axially extending ridges. Indeed, ridges 210 extending in a direction at an angle with the axis of rotation 118, e.g. ridges spiraling around the axis of rotation, are also possible. However, in the configuration shown in FIG. 2, this would lead to differences in the length of the different liquid channels 212, and thus in the quantity of liquid that the different channels collect and discharge. This may be undesirable. In contrast, the configuration with a brush rotating around a vertical axis of rotation allows using ridges which extend at an angle with the axis of rotation without this possible drawback.

In the embodiment shown in FIG. 2 and FIG. 3, the outfalls 214 of the liquid channels 212 are formed by the lower edges of the liquid channels. From the outfalls 214, the collected liquid may trickle down onto the floor in a distributed, fine-spread fashion. In an advantageous alternative embodiment, the lower part of cover part surface 207 comprising the outfalls 214 bends inward, towards the brush 114 being shielded, such that the outfalls 214 effectively contact the brush material of the brush 114 when it is rotated. Liquid arriving at the outfalls 214 and ready to be discharged will now be swept out of the outfalls 214 by the rotating brush 114, and will at least be partially absorbed by the brush material thereof. In this embodiment, collected liquid is thus not discharged onto the floor but fed back into the brush 114 instead. It is noted that the moistening profile of the brush is unlikely to be influenced when such feedback is used with the cover part surface configuration shown in FIG. 2, wherein each liquid channel 212 is associated with an axial region of the brush 114 having a width which is about the same as width WL of the respective liquid channel. This is because relatively wet axial regions of the brush 114, which may shake out a relatively large quantity of liquid, will face a proportionally large feedback of liquid, whereas the opposite holds true for relatively dry axial regions of the brush 114. The degree to which the outfalls 214 contact or penetrate the brush material may vary. The farther the lower part of the cover part surface 207 comprising the outfalls 214 penetrates the brush material, the more liquid may be swept out of the outfalls 214 and the adjacent upstream parts of the liquid channels 212. A greater degree of penetration may be accompanied by a greater degree of wear of the brush material, as the area over which the cover part surface 207 and the brush material continuously contact each other increases accordingly.

While the invention has been illustrated and described in detail in the drawings and the foregoing description, such illustrations and the description arc to be considered illustrative or as examples and are not limiting; the invention is not limited to the disclosed embodiments. Variations of the disclosed embodiments can be understood and effected by those skilled in the art in practicing the claimed invention, from a study of the drawings, the disclosure, and the appended claims. In the claims, use of the verb 'comprise' and its conjugations does not exclude other elements or steps, and the indefinite article 'a' or 'an' does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A floor cleaning apparatus comprising:

a driven brush that is rotatable around an axis of rotation; and a cover mounted adjacent to the driven brush, said cover having an inner surface facing the axis of rotation and partially surrounding said driven brush so as to collect liquid thrown off thereby during operation, said inner surface defining a plurality of ridges forming therebetween axially distributed liquid channels for transporting the collected liquid downwardly to respective distributed areas of the floor being cleaned, where the driven brush comprises a brush material and where ends of the liquid channels are disposed to contact said brush material when said driven brush is being rotated.

2. A floor cleaning apparatus according to claim 1 where the ridges extend in a direction having a component parallel to the direction of gravity when the cleaning apparatus is in a working orientation.

3. A floor cleaning apparatus according to claim 1 where the ridges extend substantially parallel to each other.

4. A floor cleaning apparatus according to claim 1 where an interspacing (WL) between the ridges is the same for any two adjacent ridges.

5. A floor cleaning apparatus according to claim 1 where the driven brush comprises a substantially cylindrical or prismatic core which is concentric to the axis of rotation.

6. A floor cleaning apparatus according to claim 5 where the ridges extend in a direction substantially perpendicular to the axis of rotation.

7. A floor cleaning apparatus according to claim 1 where the ridges are provided on the cover inner surface over a longitudinal length of the brush.

8. A floor cleaning apparatus according to claim 1 where the cover inner surface is curved around the exterior of the brush.

9. A floor cleaning apparatus comprising:

a driven brush that is rotatable around an axis of rotation; and a cover mounted adjacent to the driven brush, said cover having an inner surface facing the axis of rotation and partially surrounding said driven brush so as to collect liquid thrown off thereby during operation, said inner surface defining a plurality of ridges forming therebetween axially distributed liquid channels for transporting the collected liquid downwardly to respective distributed areas of the floor being cleaned where the ridges extend substantially parallel to each other and where an interspacing (WL) between the ridges corresponding to the width of the liquid channels is such that the liquid channels do not collect liquid through capillary action.

10. A floor cleaning apparatus comprising:

a driven brush that is rotatable around an axis of rotation; and a cover mounted adjacent to the driven brush, said cover having an inner surface facing the axis of rotation and partially surrounding said driven brush so as to collect liquid thrown off thereby during operation, said inner surface defining a plurality of ridges forming therebetween axially distributed liquid channels for transporting the collected liquid downwardly to respective distributed areas of the floor being cleaned, where the ridges protrude no more than 5 mm from the cover inner surface.

* * * * *